United States Patent [19]

Tanabe et al.

[11] Patent Number: 4,893,052

[45] Date of Patent: Jan. 9, 1990

[54] CATHODE STRUCTURE INCORPORATING AN IMPREGNATED SUBSTRATE

[75] Inventors: Hideo Tanabe; Mamoru Tsuzurahara, both of Mobara, Japan

[73] Assignee: Hitachi, Ltd., Tokyo, Japan

[21] Appl. No.: 3,325

[22] Filed: Jan. 14, 1987

[30] Foreign Application Priority Data

Mar. 14, 1986 [JP] Japan ..... 61-54784

[51] Int. Cl.[4] ..... H01J 1/14; H01J 19/06

[52] U.S. Cl. ..... 313/346 R; 313/292; 313/332; 445/50

[58] Field of Search ..... 313/346 DC, 346 R, 355, 313/292; 445/50, 51

[56] References Cited

U.S. PATENT DOCUMENTS 3,488,549 1/1970 Amra ..... 445/50

4,349,581 9/1982 Asano et al. ..... 427/53.1

FOREIGN PATENT DOCUMENTS 56-86436 7/1981 Japan .

59-108233 6/1984 Japan .

*Primary Examiner*—Robert L. Griffin

*Assistant Examiner*—T. Salindong

*Attorney, Agent, or Firm*—Antonelli, Terry & Wands

[57] ABSTRACT

A cathode structure comprises a substrate including a porous sinter of a metal having a high melting point, which is impregnated with electron emitting material, a metal cup for receiving the substrate, a layer of solder disposed between the substrate and the metal cup, a covering layer disposed between the substrate and the solder layer and made of a metal having a melting point higher than that of the solder, a metal sleeve for supporting the metal cup, and a heater.

20 Claims, 1 Drawing Sheet

CATHODE STRUCTURE INCORPORATING AN IMPREGNATED SUBSTRATE

FIELD OF THE INVENTION AND RELATED ART STATEMENT

The invention relates to a cathode structure incorporating an impregnated substrate.

In the conventional cathode structure of the type above-mentioned, as disclosed, for example, in Japanese Patent Unexamined Publication No. 59-108233, bonding members are interposed and fused between a substrate impregnated with an electron emitting material, e.g. a tungsten porous substrate and a metal container cup so as to partly bond them together. This construction is attempted to overcome the difficulty in effecting a direct spot welding between the tungsten substrate and the metal container cup.

Such construction, however, can not provide a sufficient bonding strength therebetween. In addition, there is involved the problem that the fused bonding members come directly into contact with the electron emitting material impregnated into the substrate and cause an adverse effect upon such material

OBJECT AND SUMMARY OF THE INVENTION

An object of the invention is to provide a cathode structure which entirely eliminates the above-mentioned problem.

To this end, according to the invention, there is provided a cathode structure in which, between a porous substrate and a metal supporting means, a layer of solder and a covering layer of material having a melting point higher than that of the solder are disposed.

According to the invention, it is ensured that the porous substrate and thus supporting means are bonded widely by the soldering and thus a higher bonding strength is obtained. Further, since the covering layer prevents the melted solder from permeating into the porous substrate, the pores in the substrate are not clogged, so that they can be fully impregnated with the electron emitting material.

Other objects, functions and meritorious advantages of the invention will be apparent from the following description of the preferred embodiments.

DETAILED DESCRIPTION OF PREFERRED EMBODIMENTS

Figure 1:
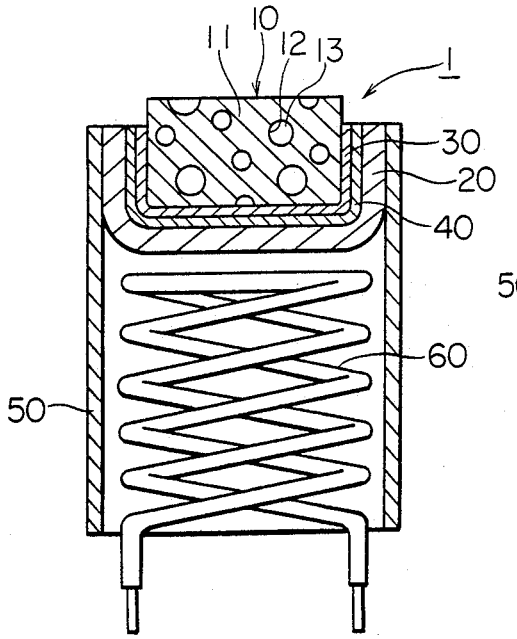
FIG. 1 is an enlarged longitudinal sectional view of one embodiment of the invention.

Referring to FIG. 1, a cathode structure 1 comprises a substrate 10, a metal cup 20, a covering layer 30, a layer 40 of solder, a metal supporting sleeve 50 and a heater 60.

The substrate 10 includes a porous tungsten sinter 11 with a porosity between 20 and 25%, pores 12 of which are impregnated with an electron emitting material 13 such as barium-calcium-aluminate. It is to be noted that the pores 12 are shown artificially enlarged so as to facilitate the explanation thereof.

The cup 20 is made of molybdenum and is shaped to receive the substrate 10 therein. The cup 20 is secured to the supporting sleeve 50 by welding. The cup 20 may be made of rhenium or ruthenium or an alloy including at least one metal selected from the group consisting of molybdenum, rhenium and ruthenium. During the operation of the cathode structure 1, the cup 20 prevents the barium, which is emitted from the substrate 10 under the heat influence by the heater 60, from adhering to the heater 60 and thus serves to avoid an undesirable deterioration of the heater 60.

The assembling of the above-mentioned cathode structure will be explained hereinafter.

At first, a covering layer 30 of tungsten or molybdenum is formed by a flame spraying on a surface of the substrate 10 facing the cup 20. The covering layer 30 generally has a thickness between 5 and 200μm, and more preferably about between 20 and 50μm. The material of the covering layer 30 is not limited to those described above and may be a material which does not affect the electron emitting and has a melting point higher than that of the solder 40. The covering layer 30 is preferably made of, for example, rhenium or ruthenium or an alloy including at least one metal selected from the group consisting of tungsten, molybdenum, rhenium and ruthenium. Since the covering layer 30 is formed by flame spraying, the melted material of the covering layer 30 is solidified simultaneously with attaching upon a surface of the substrate 10. Accordingly, clogging of the pores 12 of the substrate 10 with such melted covering layer material is negligible. The covering layer 30 may be formed by a metal plating or an evaporation or a sputtering.

Thereafter, a cup-shaped piece of solder 40 consisted of molybdenum-ruthenium eutectic is disposed in the cup 20 and then the covered substrate 10 is laid on the solder 40. The operation is carried out in an atmosphere of about 2000° C. The solder is not limited to the molybdenum-ruthenium eutectic and may be a metal having a melting point higher than that of the material of the covering layer 30.

Thereafter, the pores 12 of the substrate 10 are impregnated with the electron emitting material 13 in an atmosphere of about 1800° C.

The cup 20 is secured by laser welding or the like to the sleeve 50 made of tantalum or molybdenum. Alternatively, the cup 20 may be soldered to such sleeve simultaneously with the soldering of the substrate 10 to the cup 20.

Finally, the heater 60 is incorporated within the sleeve 50 to form a cathode structure 1. Such structure 1 is further incorporated within an electron gun (not shown).

In the above-mentioned embodiment, although the impregnation of the electron emitting material 13 is conducted after soldering of the substrate 10 to the cup 20, it may be possible that after the impregnation, the covering layer 30 is formed on the substrate 10 and then the covered substrate 10 is soldered to the cup 20. In the latter case, since the forming of the covering layer and the soldering are conducted in a short time, such operations may not affect the impregnated electron emitting material.

It is not necessary that the covering layer 30 and the soldering layer 40 are distinctly separated from each other as shown. The soldering layer 40 may partly or irregularly penetrate into the covering layer 30.

Figure 2:
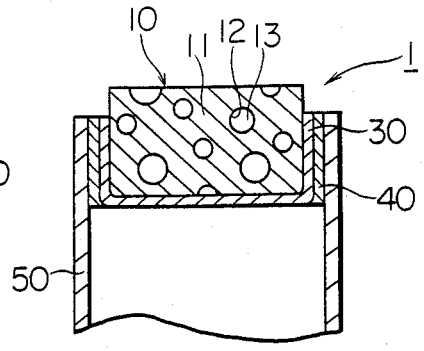
FIG. 2 is a fragmentary enlarged longitudinal sectional view of another embodiment of the invention.

In the cathode structure 1 according to another embodiment of the invention shown in FIG. 2, the cup-shaped covering layer 30 performs the same functions as the cup 20 shown in FIG. 1. The cup-shaped covering layer 30 is directly secured to the sleeve 50 through the soldering layer 40. This arrangement results in reduction of the number of the parts.

Figure 3:
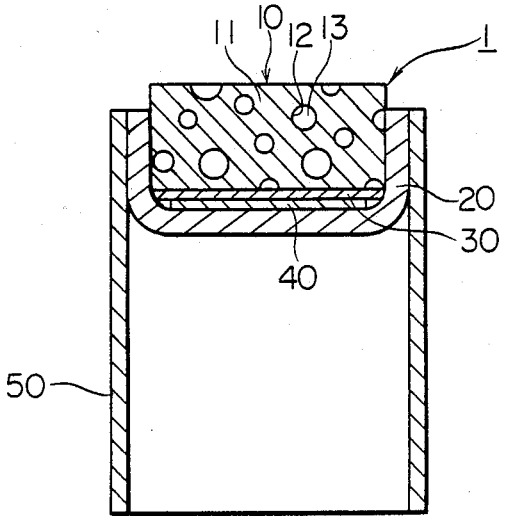
FIG. 3 is an enlarged longitudinal sectional view of a further embodiment of the invention.

In the cathode structure 1 shown in FIG. 3, a plate of solder 40 is interposed between the covered substrate 10 and the cup 20 and then is melted in a high temperature to bond them together. In this case, the covering layer 30 is formed only on a surface of the substrate 10 facing the solder plate 40.

What is claimed is:

1. A cathode structure comprising:

a substrate including a porous sinter made of high melting point metal, into which an electron emitting material is impregnated;

metal supporting means for supporting said substrate;

a layer of solder provided between said substrate and said supporting means for combining them; and a covering layer provided between said substrate and said supporting means, said covering layer being made of a metal having a melting point higher than that of said solder.

2. A cathode structure according to claim 1, wherein said covering layer is provided between said substrate and said solder layer.

3. A cathode structure according to claim 2, wherein said structure further comprises a metal cup provided between said solder layer and said metal supporting means.

4. A cathode structure according to claim 1, wherein said metal covering layer is made of a metal selected from the group consisting of tungsten, molybdenum, rhenium, ruthenium and an alloy including at least one of them.

5. A cathode structure according to claim 3, wherein said metal cup is made of metal selected from the group consisting of molybdenum, rhenium, ruthenium and an alloy including at least one of them.

6. A cathode structure according to claim 2, wherein said covering layer is formed by flame spraying.

7. A cathode structure according to claim 4, wherein said porous sinter is made of tungsten.

8. A cathode structure according to claim 4, wherein said solder is made of molybdenum-ruthenium eutectic.

9. A cathode structure according to claim 2, wherein said solder layer is formed by fusing a solder plate disposed between said metal supporting means and said covering layer.

10. A cathode structure according to claim 2, wherein said covering layer presents a cup shape.

11. A cathode structure according to claim 3, wherein said solder layer is formed by fusing a solder plate disposed between said metal cup and said covering layer.

12. A cathode structure comprising:

a substrate comprising a porous sinter made of high melting point metal impregnated with an electron emitting material;

a metal supporting sleeve for supporting said substrate;

a metal cup shaped to receive said substrate therein secured to said metal supporting sleeve;

a layer of solder provided between said substrate and said metal cup for bonding said substrate within said metal cup; and a covering layer provided between said substrate and said layer of solder, said covering layer being made of a metal having a melting point higher than a melting point of said solder, wherein said covering layer is arranged so as to prevent said solder from permeating into said substrate.

13. A cathode structure according to claim 12, wherein said substrate comprises porous sintered tungsten impregnated with barium-calcium-aluminate.

14. A cathode structure according to claim 12, further comprising heating means provided in said metal supporting sleeve for heating said substrate.

15. A cathode structure according to claim 12, wherein said solder is made of molybdenum-ruthenium eutectic.

16. A cathode structure according to claim 12, wherein said covering layer is made of a material selected from the group consisting of tungsten, molybdenum, rhenium, ruthenium and an alloy including at least one of tungsten, molybdenum, rhenium and ruthenium.

17. A cathode structure according to claim 12, wherein said metal cup is made of a material selected from the group consisting of molybdenum, rhenium, ruthenium and an alloy including at least one of molybdenum, rhenium and ruthenium.

18. A cathode structure according to claim 12, wherein said covering layer has a thickness between 5 and 200 $\mu$m.

19. A cathode structure according to claim 12, wherein said covering layer has a thickness between 20 and 50 $\mu$m.

20. A cathode structure according to claim 12, wherein said covering layer is formed on said substrate by flame spraying.

* * * * *